United States Patent [19]

Thalenfeld et al.

[11] Patent Number: 4,718,626

[45] Date of Patent: Jan. 12, 1988

[54] DISPLAY DEVICE WITH LABEL MOUNT OR THE LIKE

[75] Inventors: David R. Thalenfeld, Bear Creek; Joel I. Glickman, Huntingdon Valley, both of Pa.

[73] Assignee: Trion Industries, Inc., Wilkes-Barre, Pa.

[21] Appl. No.: 902,431

[22] Filed: Aug. 29, 1986

[51] Int. Cl.[4] ..... A47F 5/00

[52] U.S. Cl. ..... 248/225.1; 248/221.3; 248/223.4; 211/57.1; 40/10 R

[58] Field of Search ..... 248/225.1, 220.4, 221.3, 248/223.4, 222.2, 221.4, 222.1, 223.1, 224.1, 224.2, 231.8, 309.1; 40/10 R, 584; 211/57.1, 59.1, 54.1

[56] References Cited

U.S. PATENT DOCUMENTS

| | | | |
|---|---|---|---|
| 1,720,309 | 7/1929 | Wakefield | 248/223.4 |
| 2,708,088 | 5/1955 | Steinke | 248/309.1 |
| 2,891,745 | 6/1959 | Seyfried | 248/221.3 |
| 2,954,951 | 10/1960 | Dorothea | 248/309.1 |
| 3,696,916 | 10/1972 | Penniman | 248/311.2 |
| 4,405,051 | 9/1983 | Thalenfeld | 248/220.4 |

FOREIGN PATENT DOCUMENTS

| | | | |
|---|---|---|---|
| 638975 | 11/1936 | Fed. Rep. of Germany | 248/222.2 |
| 2447 | of 1913 | United Kingdom | 248/221.3 |
| 489181 | 7/1938 | United Kingdom | 248/221.3 |
| 1016563 | 1/1966 | United Kingdom | 248/223.4 |

*Primary Examiner*—Reinaldo P. Machado
*Assistant Examiner*—Alvin Chin-Shue
*Attorney, Agent, or Firm*—Schweitzer & Cornman

[57] ABSTRACT

In a merchandise display hook with label holder, wherein the hook has a flat mounting plate of standard size for mounting an information label holder of variable size and shape, an improved one-piece, molded label holder is provided which has a flat, plate-like label support provided with a wand-supporting flange along its lower edge. Mounting flanges are formed on the back of the label support. These are of L-shaped cross section and are formed by side flange portions and back flange portions. The label support has through openings which are at least co-extensive in size and shape with the back flange portions, enabling the back flange portions to be formed by mold projections extending through the label support from the front side of the mold. A deflectable locking tongue secures the label holder in position on the mounting plate, once installed. The special construction of the label holder accommodates high speed, mass production molding such that a functionally superior molded label holder is economically competitive with known, extruded designs.

7 Claims, 6 Drawing Figures

DISPLAY DEVICE WITH LABEL MOUNT OR THE LIKE

BACKGROUND AND SUMMARY OF THE INVENTION

Merchandise display hooks are utilized in a wide variety for the display of carded merchandise and the like. Typically, such merchandise display hooks are formed of wire, providing one or more outwardly extending wire arms for the support of merchandise and/or information. At the back of the hook, there is mounted a base plate or base member, by which the hook may be secured to a display panel. Typically, the base member is provided with a pair of L-shaped lugs engageable with adjacent openings in an apertured panel board.

To an increasing extent, merchandisers setting up point-of-purchase displays with merchandise display hooks are utilizing in conjunction therewith an information label, containing such information as price, product description, bar code information, etc. The bar code information is of particular significance, in that it enables semi-automation of the task of inventorying the display products. Accordingly, it is becoming more common for merchandise display hooks to incorporate a first wire-like arm (sometimes two) for the support and display of merchandise, and a second wire-like arm, extending above the first, for support of an information display label. Particularly advantageous forms of merchandise display hooks for this purpose are shown in prior U.S. Pat. Nos. 4,351,440, 4,405,051 and 4,474,351, issued to Trion Industries Inc., Wilkes-Barre, Pa. The present invention is directed to merchandise display hooks of the general type reflected in these earlier patents, but incorporating features of improvement particularly with respect to the mounting of a label support on the end of a wire-like arm.

In accordance with a particular aspect of the invention, an improvement is made in a merchandise display hook of the general type described in my earlier U.S. Pat. No. 4,405,051, with particular reference to improvements in the plastic label holder mounted at the outer end of the display hook. More specifically, the improvements of the present invention are directed to the provision of a novel and improved plastic label holder, which is of molded construction, incorporating features to facilitate the initial installation of the label holder on the hook device and to assure precise and uniform positioning of the label holder.

In the hook design of my earlier U.S. Pat. No. 4,405,051, a label support arm is provided at its outer extremity with a rectangular metal plate, which is preferably secured by welding. The metal plate is of a standard size and configuration for all sizes and styles of hooks. The label holder itself is a plastic device of extruded construction, having continuous horizontal flanges at the rear which are slideable laterally over the metal mounting plate. In the prior device, the plastic label holders were of extruded construction, which accommodated low cost manufacture of the label holder material in continuous strip form, which could then be cut to any predetermined length to be customized for individual users. The display hook of the U.S. Pat. No. 4,405,051 has been extremely successful commercially. Nevertheless, we have perceived opportunity for still further improvement, particularly in the area of label positioning.

Customarily, in the marketing of a two-part display hook, such as shown in our U.S. Pat. No. 4,405,051 it is customary to ship the two parts in disassembled condition, with the final assembly being performed by store personnel. This gives the store management the desired flexibility with respect to the size of the label holders etc. One of the disadvantages, however, is that the store personnel may be somewhat careless in centering the extruded label holders on the metal mounting plates, which may detract from the visual appearance of the overall display. Additionally, the label holders are subject to subsequent lateral movement on their mounting plates, either by customers or store personnel, even though they are mounted rather tightly on the metal plates. This too can make a merchandise display look less neat and orderly than desired.

In accordance with the present invention, a new design of plastic label holder is provided, which is mountable on the standard metal mounting plate, but which is locked in a fixed, precisely centered position for optimum visual effect. More particularly, a novel and improved plastic label holder is provided which is of molded construction, and which incorporates mounting and positioning flanges and abutments for precisely locating the label holder on the metal mounting plate.

In general concept, the use of molded label holding plates is of course not new. For example, a molded plate was proposed in my earlier U.S. Pat. No. 4,351,440. Nevertheless, the use of molded label holding plates has not heretofore been commercially successful because of what was thought to be the inherently higher cost of the molded device. In accordance with the present invention, however, the molded plastic label holder is so designed and constructed that it can be mass produced on high speed, automatic molding machinery, such that its cost is entirely competitive with label holders of extruded construction. The new label holder is functionally greatly superior to the extruded item, however, because of the facility with which the molded label holder may be mounted on the hook and the positive manner in which the label holder is positioned.

To advantage, the improved molded label holding plate of the invention includes spaced, vertically disposed mounting flanges, which are open at the bottom for vertically downward application over a flat metal mounting plate. Abutment means at the upper edge of the label holder limit the downward movement thereof and serve to position the label holder on the metal mounting plate. A resiliently deflectable locking element, which is displaced during the initial application of the label holder over the mounting plate, returns to its normal position when the parts are fully assembled, and serves to lock the label holder in position on the mounting plate. The locking element, accessible from the rear of the label holder, is normally concealed by the presence of a label on the holder from the view of the casual observer to minimize unauthorized removal of the label holder.

In accordance with one of the specific aspects of the invention, the molded plastic label holder is provided with vertically elongated openings in the front face of the label holder, directly in front of mounting flanges provided at the back of the label holder for engaging the vertical side edge margins of a metal mounting plate. The provision of the elongated vertical openings allows for the insertion of mold elements from the front portion of the mold, through the body of the label holder, to define the front facing surfaces of the mounting flanges. This allows for the use of simple, high speed automatic molding machinery in the formation of the relatively complex flange structure. The use of such machinery is of course critical in enabling the functionally superior molded part to be manufactured on a price-competitive basis with the extruded unit.

As an additional feature of advantage, the molded plastic label holder is provided, in the regions below the mounting flanges, with downwardly extending, divergently related integral ribs projecting from the back surface of the flat, plate-like label support structure of the label holder. These ribs serve not only to add strength to the lower portion of the flat label holder, but they are arranged and located to assist in guiding the metal mounting plate into the confined slots formed by the mounting flanges and thus to facilitate the initial mounting operation.

For a more complete understanding of the above and other features and advantages of the invention, reference should be made to the following detailed description of a preferred embodiment, and to the accompanying drawing.

DESCRIPTION OF A PREFERRED EMBODIMENT OF THE INVENTION

Figure 2:
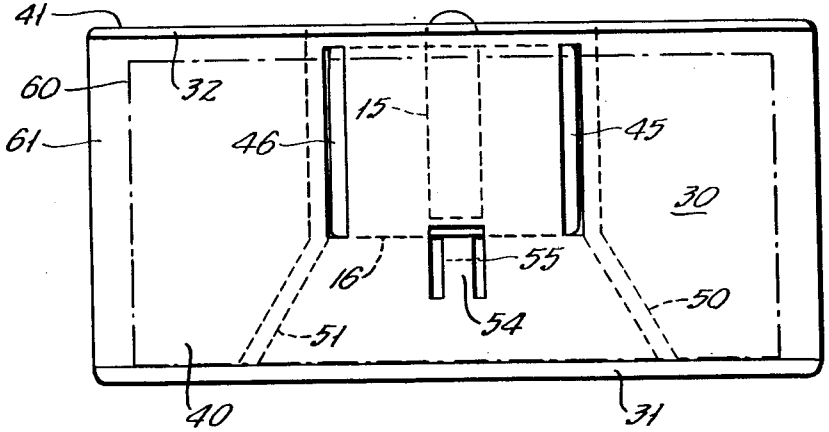
FIG. 2 is a front elevational view of the molded plastic label holder of the invention.
Figure 1:
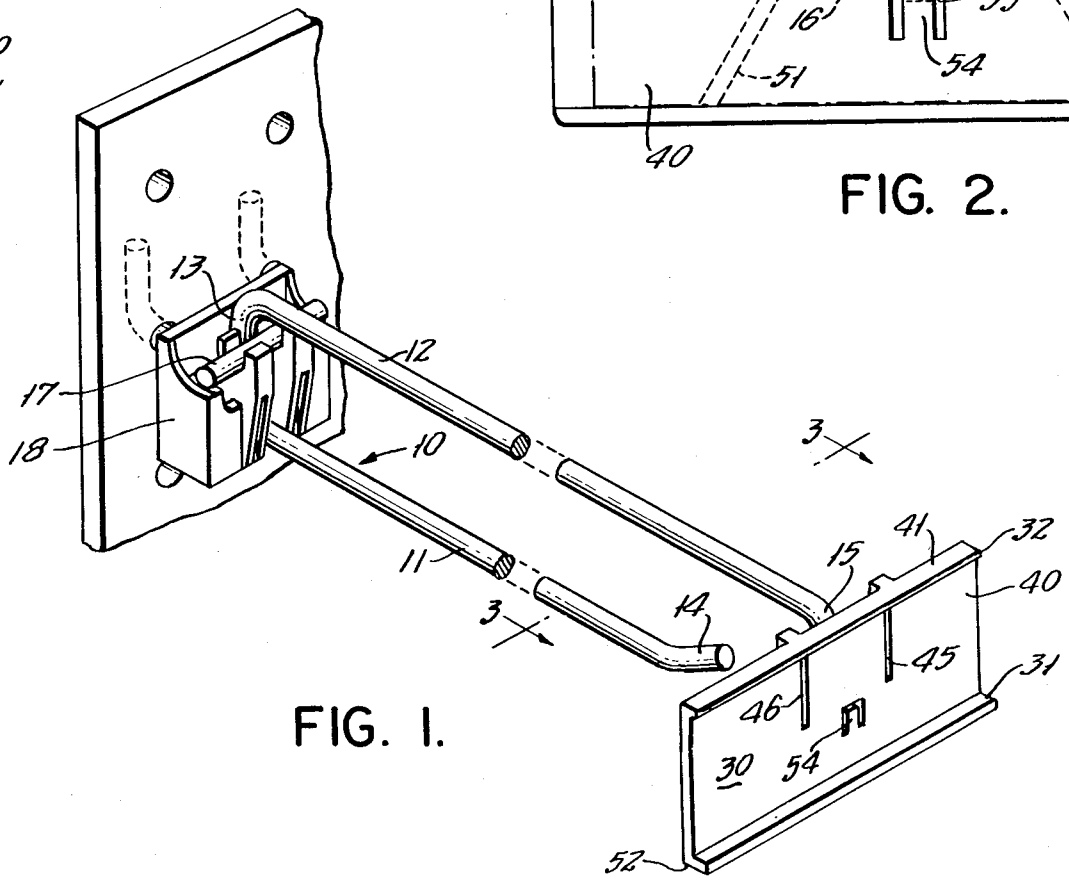
FIG. 1 is a perspective illustration of a typical form of merchandise display hook incorporating the new label holder feature of the invention.
Figure 4:
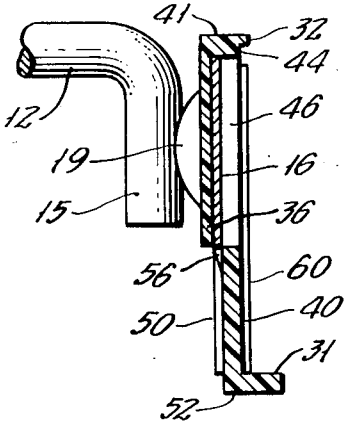
FIG. 4 is a cross sectional view as taken generally on line 4—4 of FIG. 5.

Referring now to the drawings, and initially to FIG. 1, there is illustrated a commercially popular form of merchandise display hook with front label holder means, generally according to my prior U.S. Pats. Nos. 4,405,051 and 4,474,351, owned by Trion Industries Inc., Wilkes-Barre, Pa. The form of the hook device illustrated in FIG. 1 is especially advantageous, although not required by the present invention. It includes a wire section 10 formed into a generally U-shaped configuration to provide a lower, outwardly extending merchandise supporting arm 11 and an upper, outwardly extending label support arm 12. The outwardly extending arms 11 and 12 are connected at their inner ends by a short integral vertical section 13. Conventionally, the merchandise support arm 11 is provided with an upturned portion 14 at its outer extremity. The label support arm 12 extends outwardly beyond the extremity 14 of the merchandise support arm and terminates in a downturned portion 15, to which is secured a rectangular mounting plate 16, to be further described.

The vertical connecting section 13 advantageously mounts a cross bar 17, which is secured by welding. In the illustrated form of device, the cross bar 17 and vertical connecting section 13 are received in a specially contoured plastic base member 18, details of which are furnished in my earlier U.S. Pat. No. 4,474,351, incorporated herein by reference.

In accordance with known features of my earlier U.S. Pat. No. 4,405,051, but nevertheless significant to the improvements of the present invention, the mounting plate 16 comprises a relatively thin, stiff metal plate of generally rectangular configuration. By way of example only, the plate 16 may be on the order of 11/16th of an inch in height, and approximately one inch in width, with rounded corners to facilitate assembly operations. Desirably, the plate is provided with a central, rearwardly displaced portion 19 of generally circular outline, which may in turn be provided with a central, vertical trough-like area (not specifically identified) for the reception of the vertical portion 15 of the label support arm 12. In the production of the hook elements, the mounting plates 16 are welded to the vertical wire sections 15 in a precise alignment, so as to be perpendicular to the vertical plane containing the wire arms 11, 12. The vertical edges 20 of the mounting plate (see FIG. 3) are parallel to the plane of the arms 11, 12 (i.e. vertical, when mounted on a wall panel as shown in FIG. 1), and the upper and lower edges 21 of the metal plate are normal to the plane of the arms 11, 12.

In accordance with teachings of my earlier U.S. Pat. No. 4,351,440, incorporated herein by reference, the arrangement of the mounting plate 16, label holder 30 and the label support wire 12 is such that the label holder projects generally downward from the label support arm 12, while the forward extremity 14 of the merchandise support arm 11 is located generally directly behind the label holder, such that the label holder serves as protection against contact with the outer end of the merchandise support arm. Likewise, preferably there is minimal if any extension of the label holder above the level of the label support arm 12, so as to avoid interfering with merchandise displayed directly above the label holder.

In accordance with the specific improvement features of the invention, the label holder 30, secured to the mounting plate 16, comprises a unitary member of molded plastic construction, the molded construction being regarded as significant to the invention.

With reference now more particularly to FIGS. 2-5, the label holder 30 typically is in the form of a rectangular plate of relatively thin, flat form. The particular size and shape of the label holder is largely a matter of customer preference, and it is inbead one of the features of the invention that the design of the label holder device accommodates rather easy modification of mold configuration in order to provide customized label holders suited to the end user's needs and/or desires. In a typical case, the main flat label support of the label holder may be approximately three inches in width and approximately 1.25 inches in height, with a primary thickness of approximately 1/16th of an inch. Running full length along the bottom edge of the label holder is a guide flange 31. Desirably, this projects forward an eighth of an inch or so and provides a convenient guide surface for supporting the end of a scanning wand, typically used in reading bar code information from a label mounted on the label support. The guide flange 31 also rigidifies the label holder in the width direction, as will be appreciated. To advantage, the upper edge of the label holder is provided with a small, forwardly projecting bead 32, the function of which are partly aesthetic, partly to strengthen the upper edge of the label support and partly to avoid a sharp corner along the upper forward edge of the label holder.

Figure 6:
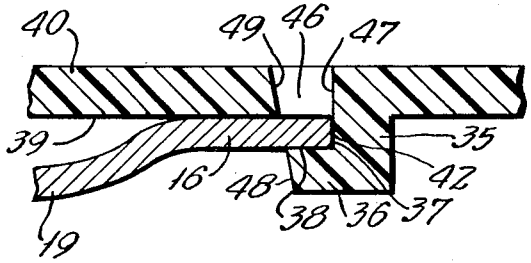
FIG. 6 is an enlarged, fragmentary cross sectional view as taken generally on line 6—6 of FIG. 3.

Formed integrally on the back surface of the label support are vertical guide flanges 33, 34. These are of uniform, L-shaped cross section throughout most of their length, as reflected in FIG. 6. Each includes a rearwardly projecting side flange section 35 and a laterally inwardly projecting back flange section 36. The distance between the inner walls 37 of the side flange sections 35 is slightly greater than the width of the mounting plate 16, enabling the mounting plate to fit easily between the opposed side flange sections 35, but without any noticeable lateral looseness. Similarly, the forward facing surfaces 38 of the back flange sections 36 are spaced rearwardly of the back surface 39 of the flat, plate-like label support 40 of the label holder by a distance approximately equal to the thickness of the mounting plate 16 at its side edge extremities.

Adjacent the top edge 41 of the label holder, the mounting plate receiving slots 42 are closed off by abutment walls 43, 44. As shown particularly in FIG. 3, these abutment walls 43, 44 provide a limit stop when the label holder 30 is assembled with the mounting plate 16, permitting the label holder to be lowered over the mounting plate to a predetermined, desired assembled position. When the label holder is thus assembled, the side edges of the mounting plate are "captured" by the L-shaped vertical flanges 33, 34, as reflected in FIGS. 3 and 6, such that the label holder is securely affixed to and positioned on the metal display hook assembly.

Desirably, the L-shaped mounting flanges 33, 34 extend from the upper extremities of the label holder 30 downward a sufficient distance to provide an adequately strong and secure engagement with the mounting plate 16. In a typical case, the vertical height of the mounting flanges will approximately equal the height of the mounting plate itself. They may be somewhat shorter, provided an adequately secure engagement is provided between label holder and mounting plate. Likewise, they may be somewhat greater in height, although because of the manner in which the mounting flanges are constructed in accordance with the invention, it is generally undesirable to make the mounting flanges any longer than necessary. In order to provide for the production of the new label holder by high production, automatic molding equipment, it is advantageous to form in the flat, plate-like label support section 40 of the label holder a pair of spaced, vertical through openings 45, 46, which are co-extensive in size and shape with the back flange sections 36 of the respective mounting flanges 33, 34. The through openings 45, 46 enable the back flanges 36 and side flanges 35 to be formed by mold elements projecting through the label support 40 from the front of the label holder, accommodating separation of front and back mold halves without any complicated, compound movement or the like. As reflected in FIG. 6, the outer wall 47 of the through opening 46 is aligned with and, in effect, forms a continuation of the wall 37 of the side flange. Similarly, the inwardly facing end wall 48 of the back flange is aligned with the inner wall 49 of the through opening. This unique and advantageous arrangement greatly simplifies the mold structure, to the point where the label holding unit may be manufactured on a high production, low cost basis through automatic molding machinery, to be entirely cost competitive with the counterpart extruded label holder, yet superior functionally thereto.

As will be appreciated, the provision of vertical through openings 45, 46, if extended unnecessarily, could structurally weaken the label holder. Accordingly, the back flanges 36, which require the presence of co-extensive vertical through openings 45, 46, preferably are no greater in length than necessary. Typically, the back flanges will be no greater in length than the height of the mounting plate 16 and, in some cases, might be somewhat shorter.

Figure 3:
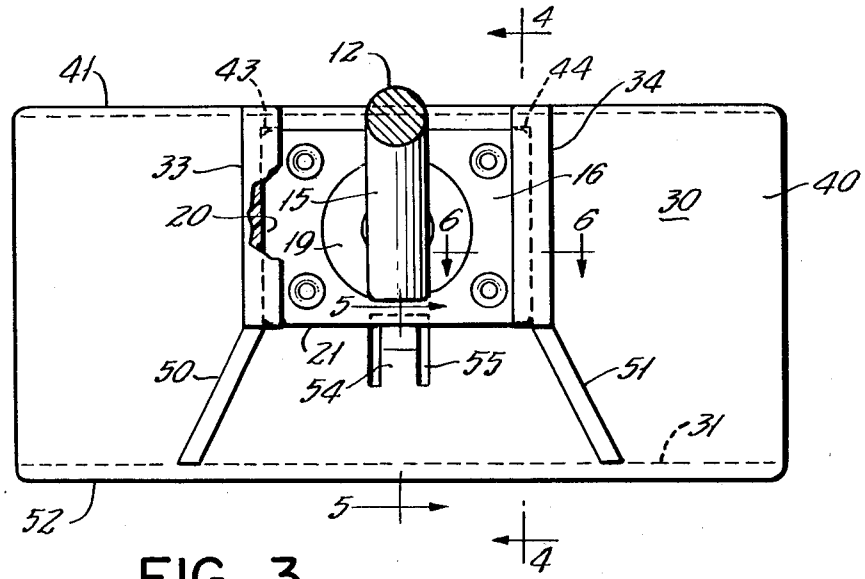
FIG. 3 is a cross sectional view generally as taken along line 3—3 of FIG. 1, providing a back view of the label holder of the invention as mounted on the display hook device of FIG. 1.

As illustrated particularly in FIG. 3, the back surface of the label holder is provided with rearwardly projecting ribs 50, 51, which extend downward from the side flanges 35, preferably to the bottom edge 52 of the label holder and preferably in somewhat divergent relation, so as to be spaced wider apart at the bottom than at the top. The ribs 50, 51 serve two purposes: One, to rigidify the lower portion of the label holder in the vertical direction, and, additionally, to provide guide surfaces for guiding the mounting plate 16 into the slots 42 defined by the mounting flanges 33, 34. This expedites the manual assembly of the label holders to the mounting plates as will be readily appreciated.

To avoid accidental dislodgement of a label holder from its mounting plate, and to minimize unauthorized removal, the label holding device of the invention is provided with an integral, resiliently deflectable locking tongue 54. The tongue is defined by an inverted U-shaped slot 55, which extends through the main plate portion of the label holder and is formed by appropriate projecting elements in either the front or the back side of the mold. As reflected in FIG. 5, the upper portion of the locking tongue 54 is formed with an integral, abutment section 56 of generally triangular cross sectional configuration, having an inclined back surface 57 and a generally flat, upwardly facing abutment surface 58. The abutment surface 58 projects rearwardly of the back surface 59 of the label support 40, typically a distance approximating the thickness of the mounting plate 16. Thus, when the mounting plate is fully seated in the side slots 42 and against the top abutments 43, 44, the bottom surface 21 of the mounting plate is arranged to engage the abutment surface 58, which prevents unintended separation of the mounting plate and the label holder.

Figure 5:
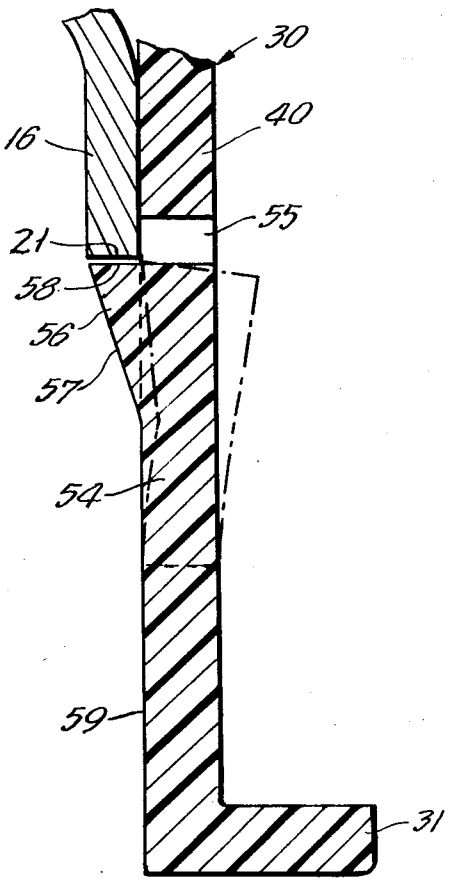
FIG. 5 is an enlarged, fragmentary cross sectional view as taken generally on line 5—5 of FIG. 3.

To accommodate assembly of the label holder to the mounting plate, the locking tongue 54 is adapted to flex forwardly, as shown in dotted lines in FIG. 5, allowing the mounting plate 16 to pass by the abutment section 56, sufficiently to clear the upper abutment surface 58 thereof. Thereupon, the resilient tongue 54 snaps back, in a rearward direction, to seat the abutment surface underneath the mounting plate and lock it into position. The label holder cannot thereafter be separated from the mounting plate without manually pressing forward on the locking tongue 54 sufficiently to clear the abutment section 56 forward of the front surface of the mounting plate.

A desirable feature of the arrangement of the locking tongue 54 is that, in normal operation, it is effectively concealed behind an opaque label. Thus, as reflected in FIG. 2, the device in normal operation has an opaque label 60 mounted thereon, usually by a self-adhesive backing. Normally, the label 60 may be approximately the same size and shape as the label holder 30. Even where it is smaller, however, the label will always be positioned in the lower center portion of the label holder, so as to completely overile the region of the locking tongue 54. This largely defeats mischievous removal of label holders from the desired display hooks.

The presence of a label, adhesively secured to the front surface of the label holder, assists the normal resilience of the plastic material in resisting forward displacement of the locking tongue 54. Accordingly, it requires a rather deliberate action to bring about a separation of label holder from its display hook.

Although it is by no means necessary, it is particularly desirable to form the label holder of a clear, colorless and highly transparent material. By way of example but not of limitation, the label holder of the invention is advantageously formed of a so-called modified K resin, a styrene based resin marketed by Phillips Petroleum under their designation KR03. By constructing the label holder of such a material, any margin 61 of the label holder (see FIG. 2) which is visible when using a label of smaller size than the label support, is visually unobtrusive. Where the material of the label holder is colored and/or opaque, it often will provide a contrasting exposed border, which can be visually disconcerting in a merchandise display containing large numbers of closely spaced merchandise display hooks. The ability to utilize clear, colorless, transparent plastic material is one of the practical benefits of the molded label holder versus the previously widely used extruded version. Plastic materials suitable for production of the extruded form of label holder, at least on an economically viable basis, do not include clear, colorless, transparent materials. While it is technically possible to provide a functionally acceptable, extruded plastic label holder of a clear, colorless, transparent material, the only materials suitable for this purpose are very expensive and thus are not commercially acceptable on a cost basis.

The device of the invention represents, in a real practical sense, a significant advance over the extruded label holder arrangement of my earlier U.S. Pat. No. 4,405,051 even though the latter has been extremely successful commercially. The molded label holder, constructed in accordance with the principles of the invention, can be manufactured on a basis which is fully cost competitive with the continuous extruded form of label holder, which is later cut to length. Nevertheless, the molded form of label holder has significant functional advantages over the extruded form in terms of ease of assembly with the hook, precise, symmetrical location of the label holder on the hook during the assembly procedure, and complete avoidance of any subsequent misalignment of the label holder by virtue of unintended lateral movement of the label holder by a customer or store clerk.

With respect to ease of assembly, the fundamental character of the extruded form of label holder requires significant frictional resistance between the label holder and the mounting plate, in order to retain the label holder in position. In contrast, the molded form of label holder device according to the invention may be designed for easy assembly, without significant frictional resistance, since the label holder is positively locked in place by the resilient locking tongue 54, once it is properly seated on the mounting plate.

Because the mounting flanges permit one and only one assembled relationship between the label holder and the mounting plate, the label holder is always perfectly positioned on the display hook, providing for neater, more appealing merchandise displays in the store.

Assembly of the label holders with the display hooks, which is typically done by store clerks in the store, after shipment from the manufacturer, is greatly expedited by the relatively friction free arrangement of the mounting flanges 33, 34 and the provision of the reinforcing guide flanges 50, 51.

It should be understood, of course, that the specific form of the invention herein illustrated and described is intended to be representative only, as certain changes may be made therein without departing from the clear teachings of the disclosure. Accordingly, reference should be made to the following appended claims in determing the full scope of the invention.

We claim:

1. In the combination of a merchandise display device including an outwardly extending label supporting arm, a mounting plate carried at the outer end of said arm, and a plastic label holder removably mounted on said mounting plate, the improvement which comprises (a) said label holder being of molded plastic construction and comprising a generally thin, flat plate-like label support having integral, forwardly projecting flange means adjacent its lower edge, (b) a pair of integral, opposed vertically oriented mounting flanges extending from the back face of said plate-like label support and forming opposed, facing retaining slots for the reception of opposite side edge margins of said mounting plate, (c) said retaining slots being formed in part by integral, vertically oriented back flange sections spaced rearwardly of said plate-like label support forming part of said mounting flanges, (d) said plate-like label support having vertically extending elongated through openings therein at least co-extensive in size and shape with said back flange sections, (g) integral abutment means adjacent the upper edge of said label holder for limiting upward movement of said mounting plate in said retaining slots, and (h) integral, deflectable locking means formed on said label support and having a rearwardly projecting abutment section positioned to closely underlie the lower edge of said mounting plate when said mounting plate is fully received in said retaining slots.

2. The improvement of claim 1, further characterized by (a) said label holder being formed of clear, colorless, transparent material.

3. The improvement of claim 1, further characterized by (a) integral strengthening ribs extending divergently downward from the lower ends of said integral mounting flanges, whereby said ribs and said integral flange means, in combination, extend substantially from the top edge to the bottom edge of said mounting plate, (b) said ribs projecting rearward from the back surface of said label support and providing means to facilitate entry of said mounting plate into said retaining slots.

4. The improvement of claim 1, further characterized by (a) said deflectable locking means being formed by a through slot of inverted U-shaped configuration formed in said plate-like label support principally below said vertically extending through openings and defining a cantilever locking tongue anchored at its lower end and having a deflectable upper end.

5. The improvement of claim 4, further characterized by (a) said locking tongue having an abutment section of generally triangular configuration providing an inclined outer surface for engagement by said mounting plate during assembly, and an upwardly facing, rearwardly projecting abutment surface engageable with the bottom edge of said mounting plate.

6. The improvement of claim 1 further characterized by (a) said integral abutment means comprising downwardly facing abutment surface means forming closed upper ends of said confining recesses, (b) said abutment surface means being aligned with the upper extremities of said vertically extending openings.

7. A label holder especially designed and adapted for mounting on a merchandise display hook, where the hook is provided with a generally rectangular flat mounting plate, which comprises a single piece molding of clear, colorless, transparent material having (a) a thin, flat label support of a size and shape to receive and support a label, (b) an integral flange extending horizontally along the bottom margin of said label support, (c) opposed, spaced integral mounting flanges projecting from the back of said label support and extending vertically thereon, (d) said mounting flanges being of generally L-shaped cross section and comprising side flange portions and back flange portions defining, together with back surface portions of said label support, confining recesses for engaging opposite side edge margins of said mounting plate, (e) said label support having vertically disposed elongated through openings therein positioned directly in front of said back flange portions, (f) said through openings being at least co-extensive in size and shape with the size and shape of said back flange portions, (g) the inner walls of said side flange portions being aligned with outer edges of said vertically disposed through openings, (h) integral upper and lower abutment means on said label support engageable with upper and lower edges of said mounting plate, (i) said lower abutment means being deflectable forwardly during insertion of said mounting plate in said confining recesses, (j) said upper abutment means being aligned with the upper extremities of said vertical through openings.

* * * * *